US008248197B2

(12) United States Patent
Newcomb

(10) Patent No.: US 8,248,197 B2
(45) Date of Patent: Aug. 21, 2012

(54) SHEATH FOR USE WITH PERMANENT MAGNET MATERIAL HANDLING DEVICE

(75) Inventor: Thomas P. Newcomb, Defiance, OH (US)

(73) Assignee: GM Global Technology Operations LLC, Detroit, MI (US)

( * ) Notice: Subject to any disclaimer, the term of this patent is extended or adjusted under 35 U.S.C. 154(b) by 1062 days.

(21) Appl. No.: 12/178,969

(22) Filed: Jul. 24, 2008

(65) Prior Publication Data

US 2010/0018893 A1 Jan. 28, 2010

(51) Int. Cl.
*H01F 7/02* (2006.01)

(52) U.S. Cl. ..... 335/302; 335/303; 206/719

(58) Field of Classification Search ..... 335/302–306; 206/701, 719, 818
See application file for complete search history.

(56) References Cited

U.S. PATENT DOCUMENTS

| | | | | |
|---|---|---|---|---|
| 2,954,140 | A * | 9/1960 | Sutherland et al. | 217/53 |
| 6,615,901 | B2 | 9/2003 | Kaminski et al. | |
| 6,694,184 | B2 * | 2/2004 | Cappa et al. | 206/818 |
| 7,383,874 | B2 | 6/2008 | Newcomb | |
| 2005/0200441 | A1 * | 9/2005 | Doi | 335/302 |
| 2010/0003113 | A1 * | 1/2010 | Stiesdal | 414/298 |

* cited by examiner

*Primary Examiner* — Bernard Rojas
(74) *Attorney, Agent, or Firm* — Fraser Clemens Martin & Miller LLC; J. Douglas Miller

(57) ABSTRACT

A sheath including a hollow main body having a first end with an opening formed therein. The hollow main body is formed from a substantially nonmagnetic material and adapted to receive the permanent magnet material handling device. The sheath militates against an attraction of foreign material to the permanent magnet material handling device when not in use. Additionally, an assembly and method for storing the permanent magnet material handling device. The assembly includes a pedestal having a stationary base coupled to a plate selectively engaging the sheath. A movement sensor may be coupled to the plate to detect movement of the plate relative to the base.

20 Claims, 3 Drawing Sheets

SHEATH FOR USE WITH PERMANENT MAGNET MATERIAL HANDLING DEVICE

FIELD OF THE INVENTION

The present disclosure relates to a permanent magnet material handling device for assembly of bore liners into sand foundry molds and, more particularly to a protective device and method for use of said device.

BACKGROUND OF THE INVENTION

In precision sand casting processes for forming an internal combustion engine block, an expendable mold package is assembled from a plurality of resin-bonded sand cores. The sand cores define the internal and external surfaces of the engine block. Resin-coated foundry sand is generally blown into a core box and cured to form the expendable mold package. A typical mold package is shown and described in commonly owned U.S. Pat. No. 6,615,901, hereby incorporated herein by reference in its entirety.

Cast-in-place bore liners are often used with the expendable mold package for engine block castings. Typically, the mold assembly method involves positioning a base core on a suitable surface, and building up or stacking separate mold elements to shape casting features such as sides, ends, a water jacket, cam openings, and a crankcase. Cast iron bore liners are positioned on barrel core features and subsequently become embedded in the engine casting after the metal is poured into the mold.

The engine block casting generally must be further machined so that the cylinder bores formed from the bore liners positioned on the barrel core features have uniform bore liner wall thickness, and that other desired block features are accurately machined. To facilitate the further machining, it is desirable that the liners be precisely and accurately positioned relative to one another within the engine block casting. The ease and consistency with which the bore liners are brought into the desired final position during the mold assembly process is an important consideration.

In barrel slab cores, the bore liners are positioned on the barrel core features by slidingly placing the bore liners over the barrel core features. A known device and method for assembling bore liners onto barrel core features is disclosed in commonly owned U.S. Pat. No. 7,383,874, hereby incorporated herein by reference in its entirety. The mold assembly device includes a magnet for securing a cast-in-place cylinder bore liner during assembly of a mold package, the magnet militating against undesirable movement of the bore liner during assembly of the mold package.

As shown in FIGS. 1 and 2, a typical robotic end-of-arm tool 10 for positioning bore liners into precision sand molds employs at least one permanent magnet 20 and a plurality of ferrous poles 40 disposed within a permanent magnet material handling device 30. The permanent magnets 20 are typically interposed between the poles 40 and are disposed inside of the permanent magnet material handling device 30. The poles 40 typically are coupled to the body of the permanent magnet material handling device 30, such as with bolts and the like, and extend outwardly from the permanent magnet material handling device 30.

The robotic end-of-arm tool 10 with the permanent magnet material handling device 30 is selectively affixed to a bore liner assembly robot that precisely positions the end-of-arm tool 10 as desired, for example, according to one or more programmable subroutines. The permanent magnets 20 have magnetic strength sufficient to secure the bore liners with the poles 40 of the permanent magnet material handling device 30 during assembly. The permanent magnet 20 may be a rare earth magnet, such as a neodymium magnet, for example. Other suitably strong permanent magnets 20 are also employed.

The permanent magnet 20 and the adjacent poles 40 may forcefully attract foreign material, including ferrous objects such as the common wrench and other hand tools which an operator may regularly use near the permanent magnet material handling device 30. The undesirable attraction of loose ferrous objects to the permanent magnet 20 and the poles 40 may create a "pinch point" hazard. Other loose ferrous bodies such as nuts, bolts, screws, and the like, and ferrous foreign material such as scrap, shavings, and the like, may further magnetically adhere to the permanent magnet 20 or the poles 40 and adversely affect the mold package assembly process. An accumulation of foreign material onto the permanent magnet assembly may undesirably result in a misalignment of the bore liner during the assembly process.

There is a continuing need for a reliable apparatus and method of assembling bore liners into precision sand foundry molds that minimizes pinch point hazards. Desirably, the apparatus detects foreign bodies attached to the magnets and militates against possible injury and scrap molds and scrap castings caused by foreign material attached to the magnet.

SUMMARY OF THE INVENTION

In concordance with the instant disclosure, a reliable apparatus and method of assembling bore liners into precision sand foundry molds that minimizes pinch point hazards, detects foreign bodies attached to the magnets and militates against possible injury, scrap molds, and scrap castings caused by foreign material attached to the magnet, is surprisingly discovered.

In one embodiment, a sheath for a permanent magnet material handling device having a permanent magnet and at least one pole includes a hollow main body having a first end and a second end. An opening is formed in the first end. The hollow main body is formed from a substantially nonmagnetic material and is adapted to receive the permanent magnet material handling device. The sheath militates against an attraction of foreign material to the permanent magnet material handling device.

In a further embodiment, an assembly for storing the permanent magnet material handling device includes the sheath and a pedestal. The pedestal includes a stationary base coupled to a plate. The plate selectively engages the sheath as desired.

In another embodiment, a method for storing the permanent magnet material handling device comprises the steps of: providing the permanent magnet material handling device; providing the sheath; inserting the permanent magnet material handling device into the sheath; and removing the permanent magnet material handling device from the sheath when employment of the permanent magnet is desired.

DRAWINGS

The above, as well as other advantages of the present disclosure, will become readily apparent to those skilled in the art from the following detailed description, particularly when considered in the light of the drawings described hereafter.

DETAILED DESCRIPTION OF THE INVENTION

Figure 1:
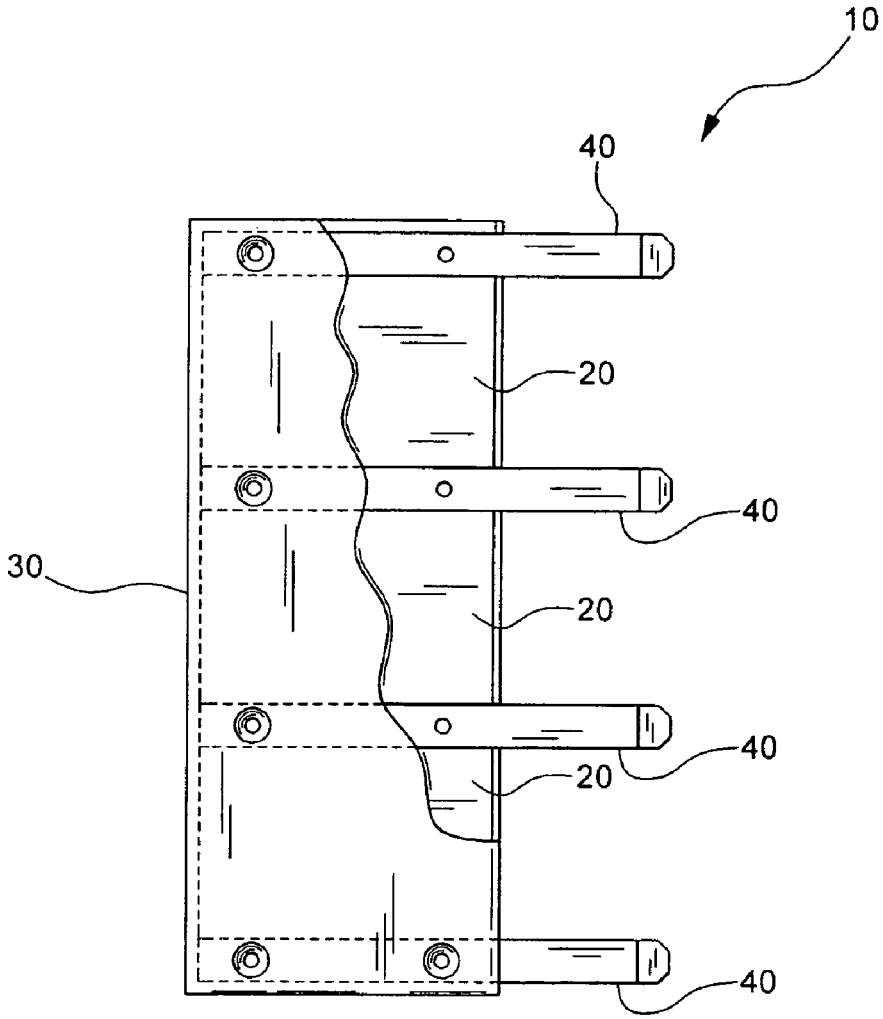
FIG. 1 (Prior Art)
FIG. 1 is a partial side elevational view of a permanent magnet material handling device of the prior art for positioning bore liners into precision sand molds.
Figure 2:
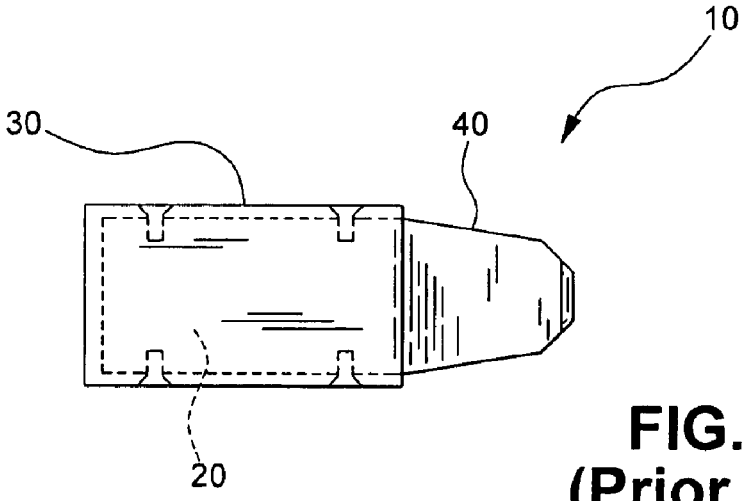
FIG. 2 (Prior Art)
FIG. 2 is an end elevational view of the permanent magnet material handling device illustrated in FIG. 1.

The following description is merely exemplary in nature and is not intended to limit the present disclosure, application, or uses. It should also be understood that throughout the drawings, corresponding reference numerals indicate like or corresponding parts and features. In respect of the methods disclosed, the steps presented are exemplary in nature, and thus, are not necessary or critical.

Figure 3:
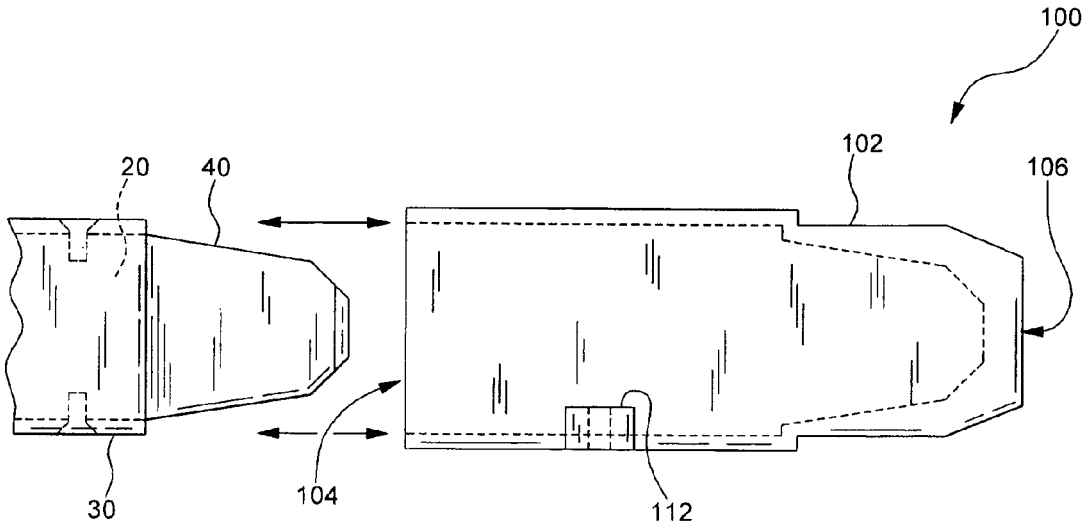
FIG. 3 is an end elevational view of a sheath according to an embodiment of the present disclosure, the sheath for use with the permanent magnet material handling device illustrated in FIGS. 1 and 2.
Figure 4:
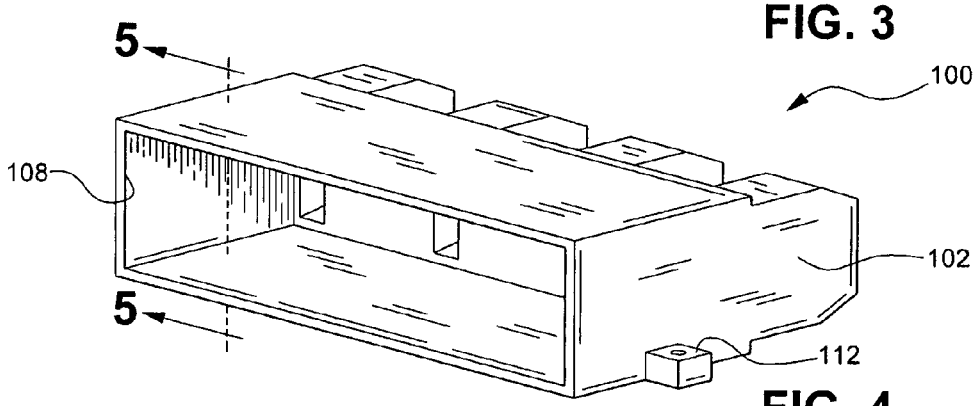
FIG. 4 is a perspective view of the sheath illustrated in FIG. 3, further showing a cavity into which a pole of the permanent magnet material handling device may be inserted.
Figure 5:
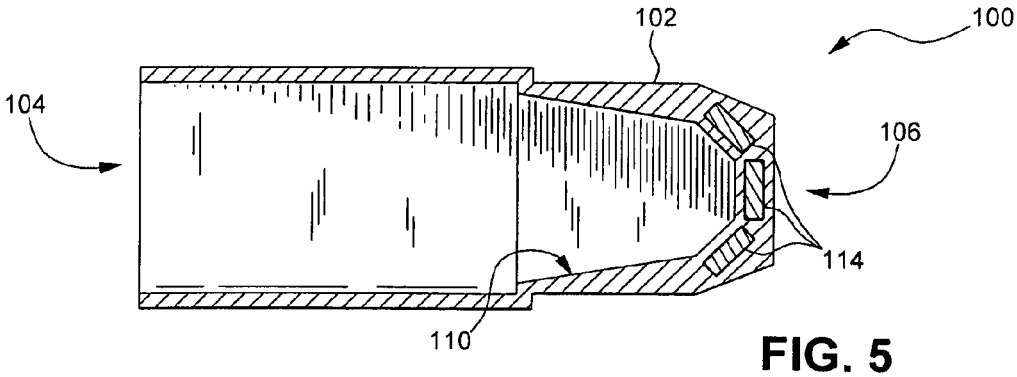
FIG. 5 is an end cross-sectional view of the sheath illustrated in FIG. 4, taken along section line 5-5 and further showing ferrous inclusions in the sheath wall.

FIGS. 3 to 5 depict a sheath 100 according to the present disclosure. The sheath 100 includes a hollow main body 102 having a first end 104 and a second end 106. An opening 108 is formed in the first end 104 of the hollow main body 102. The hollow main body 102 is adapted to receive the permanent magnet material handling device 30.

The hollow main body 102 has an interior surface 110 that substantially conforms to the shape of the permanent magnet material handling device 30, and in particular to the shape of the ferrous poles 40. It should be understood that the sheath 100 may include more than one interior surface 110, or may be coupled with additional like hollow main bodies 102, for example, to accommodate permanent magnet material handling devices 30 having the ferrous poles 40 such as shown in FIG. 1. It should further be appreciated that the sheath 100 is large enough to house the entire assembly of the robotic end-or-arm tool 10, including the permanent magnet material handling device 30 and the poles 40 coupled thereto, to provide protection on all sides and detection of all attached foreign materials.

The sheath 100 militates against an attraction of foreign material to the permanent magnet material handing device 30 while the permanent magnet material handing device 30 is inserted into the sheath 100. The sheath 100 is formed from a substantially nonmagnetic material that is effective in minimizing the magnetic attraction between the permanent magnet material handing device 30 and foreign material, such as steel tools and other ferrous bodies by maintaining physical separation between the magnetic field of 30 and the foreign material. The sheath 100 is formed from a substantially nonmagnetic material. As nonlimiting examples, the sheath 100 may be formed from one of a polymeric material such as a thermoplastic or a rubber, a cellulosic material such as wood or composites thereof, and a diamagnetic metal such as copper, tin, lead, zinc, and substantially nonmagnetic alloys thereof. Other suitable nonmagnetic materials may also be employed.

As the magnetic force diminishes with increasing distance between the permanent magnet material handling device 30 and the foreign material, the dimensions of the sheath 100 may also be configured to minimize the magnetic attraction between the permanent magnet material handling device 30 and the foreign material. As a nonlimiting example, the second end 106 to which ferrous pole 40 is disposed adjacent when inserted into the sheath 100 may have a thickness that militates against the magnetic attraction of the foreign material to the pole 40. The second end 106 adjacent the permanent magnet 20 may have a like thickness. A skilled artisan may select suitable nonmagnetic materials and dimensions, as desired.

The sheath 100 further includes at least one first coupling member 112 affixed to the hollow main body 102. The first coupling member 112 is adapted to selectively secure the sheath 100 during an insertion or a removal of the permanent magnet material handling device 30. The first coupling member 112 may be a handle, for example, enabling an operator to dispose the sheath 100 onto the permanent magnet material handling device 30. In a particular embodiment, the first coupling member 112 is a bushing adapted to receive a pin (shown in FIGS. 6 and 7). The first coupling member 112 may be affixed to the hollow main body 102 with one or more suitable fasteners. In a particularly illustrative embodiment, the first coupling member 112 is integrally formed with the hollow main body 102. For example, the first coupling member 112 may include an aperture formed in the hollow main body 102 and configured to receive the pin shown in FIGS. 6 and 7.

Referring now to FIG. 5, the sheath 100 may include at least one inclusion 114. The inclusion 114 is adapted to attract one of the ferrous poles 40 and secure the permanent magnet material handling device within the sheath 100, if, for example, the permanent magnet material handling device 30 is to be removed from the robot and transported. The inclusion 114 is generally disposed at the second end 106 of the hollow main body 102. As a nonlimiting example, the inclusion 114 may be formed within the wall of the hollow main body 102. In other embodiments, the inclusion may be deposited in a cavity formed in either the inner surface 110 or an outer surface of the hollow main body 102 adjacent the second end 106. The inclusion 114 in the cavity may be secured with a cover plate, for example. Other suitable means for securely disposing the inclusion 114 at the second end 106 of the hollow main body 102 may also be employed.

In one particular embodiment, the inclusion 114 is formed from a ferrous material. Being ferrous, it should be appreciated that the poles 40 disposed adjacent the permanent magnet 20 are attracted to the inclusion 114 via magnetic forces. Other suitable inclusions 114 for attracting the poles 40 of the permanent magnet material handling device 30 toward the second end 106 of the hollow main body 102 may be employed as desired.

In a particular example, the shape of the interior surface 110 is configured to correspond substantially to the shape of at the permanent magnet material handling device 30, including the poles 40 extending outwardly therefrom. The sheath 100 may have a clearance optimized to facilitate the detection of the foreign material adhering to the permanent magnet material handling device 30. The interior surface 110 of the hollow main body 102 may be formed to provide the clearance from the permanent magnet material handling device 30 of less than about 3 mm, in particular less than about 2 mm, and most particularly less than about 1 mm. A skilled artisan may select other suitable clearances between the permanent magnet material handling device 30 and the interior surface 110 of the hollow main body 102.

Figure 6:
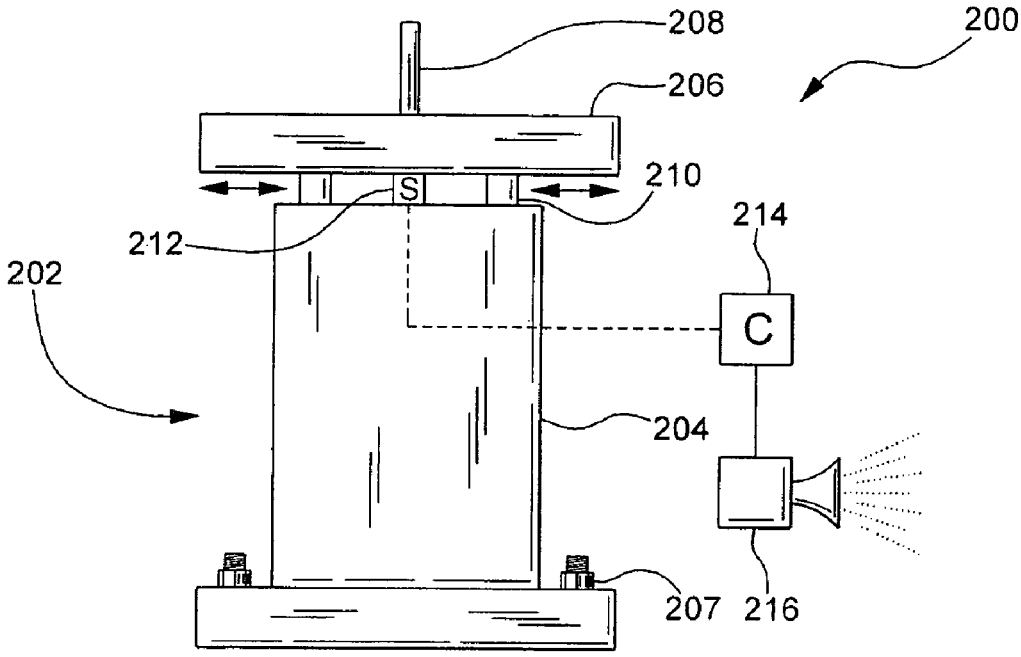
FIG. 6 is a schematic side elevational view of a pedestal for use with the sheath illustrated in FIGS. 3 to 5.
Figure 7:
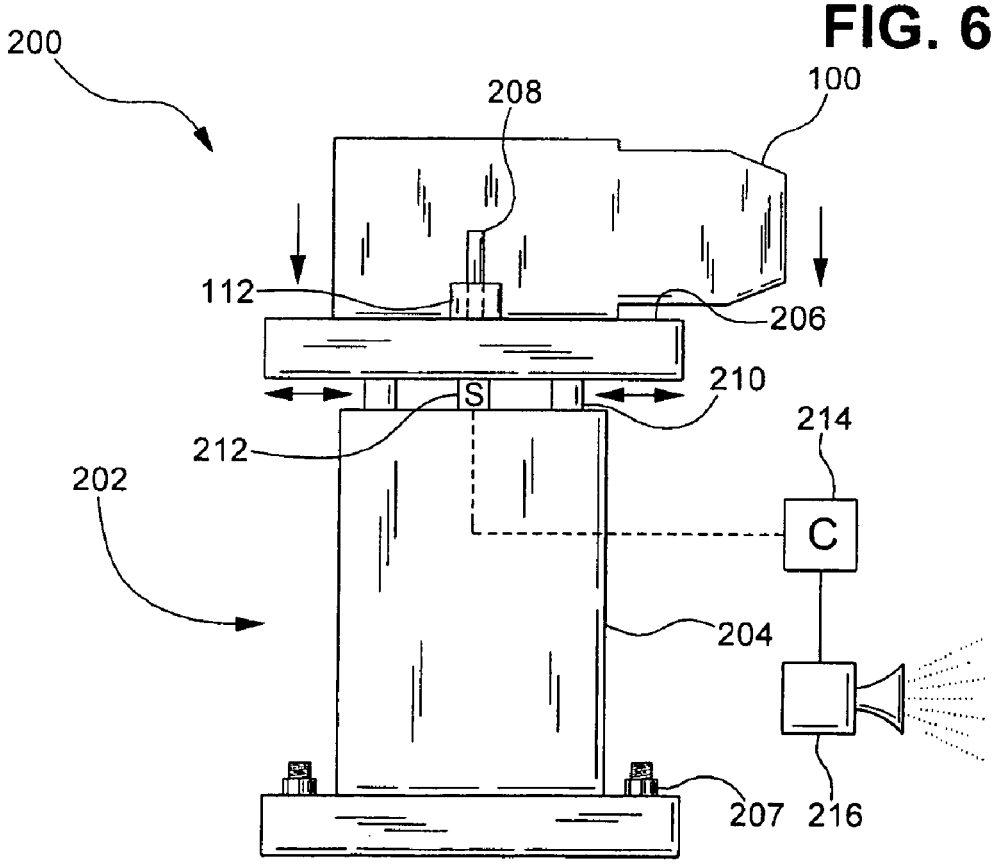
FIG. 7 is a schematic side elevational view of the pedestal illustrated in FIG. 6, shown assembled with the sheath.

An assembly 200 for receiving the permanent magnet material handling device 30 is shown in FIGS. 6 and 7. The assembly 200 includes the sheath 100 and a pedestal 202. The pedestal 202 includes a stationary base 204 coupled to a plate 206. The stationary base 204 may be securely attached to a floor, for example, with fasteners 207 such as bolts and the like. The plate 206 is adapted to selectively engage the sheath 100. The plate 100 may have at least one second coupling member 208 coupled thereto. The second coupling member 208 may selectively cooperate with the first coupling member 112 when the sheath 100 engages the pedestal 202. In one particular embodiment, the first coupling member 112 is the bushing, and the second coupling member 208 is the pin, the bushing cooperating with the pin when the sheath 100 is disposed on the plate 206. A skilled artisan should understand that other suitable first and second coupling members 112, 208, adapted to cooperate and secure and substantially immobilize a horizontal movement of the sheath 100 relative to the plate 206 when engaged with the pedestal 202, may also be employed.

In a particularly illustrative embodiment, the plate 206 is adapted to move relative to the base 204. For example, the pedestal 202 may have at least one movement facilitating member 210 disposed between the base 204 and the plate 206. The movement facilitating member 210 may be coupled to at least one of the base 204 and the plate 206. The movement facilitating member 210 enables a limited movement of the plate 206 relative to the base 204, such as a movement of the plate 206 in a substantially horizontal direction. In a particular embodiment, the movement facilitating member 210 is a spring coupled to both the base 204 and the plate 206. Other suitable means for facilitating the limited movement of the plate 206 such as a sliding rail, bearings, and the like may also be employed.

In a further embodiment, the pedestal 202 has at least one movement sensor 212 adapted to detect the movement of the plate 206 relative to the base 204. The movement sensor 212 may include a limit switch that detects motion of the plate 206 in the substantially horizontal direction. Other suitable movement sensors 212 may also be employed. The movement sensor 212 may be in electrical communication with a controller 214. The controller 214 may be configured to activate an alarm 216 and alert an operator upon detection of an undesirable movement of the plate 206. The alarm 216 may include a siren, for example. In another example, the controller 214 may control the movement of a robot being operated in the vicinity of the pedestal 202. The controller 214 may cause the robot to cease a subroutine for inserting the permanent magnet material handling device 30 into the sheath 100, for example, upon detection of the undesirable plate 206 movement indicative of foreign material on the permanent magnet material handling device 30.

The present disclosure further includes a method for storing the permanent magnet material handling device 30. The method includes the steps of providing the permanent magnet material handling device 30 having the permanent magnet 20 and the poles 40, and providing the sheath 100 as described herein. The permanent magnet material handling device 30 is then inserted into the sheath 100 during storage, and removed when employment of the permanent magnet material handling device 30 is desired. In the particular embodiment shown in FIG. 7, the permanent magnet material handling device 30 may be removed from the sheath 100 by lowering the bushings onto the pins and then withdrawing the magnet in a substantially horizontal direction. Insertion of the permanent magnet material handling device 30 into the sheath 100 may further be conducted in a substantially reverse manner. An undesirable magnetic attraction of foreign material to the permanent magnet material handling device 30 when not in use is thereby militated against.

In a further embodiment, the method includes the steps of providing the pedestal 202 described herein and disposing the sheath 100 on the pedestal 202 to place the sheath 100 in engagement with the plate 206. As shown in FIG. 7, the step of placing the sheath 100 in engagement with the plate 206 may include lowering the first coupling member 112, such as the bushing, onto the second coupling member 208, such as the pin. When assembled thusly, the sheath 100 may also be employed to monitor for the presence of the foreign material on the permanent magnet material handling device 30 during the insertion of the permanent magnet material handling device 30 into the sheath 100.

It should be appreciated that the insertion of the permanent magnet material handling device 30 into the sheath 100 while engaged with the plate 206 may result in the movement of the plate 206 if any portion of the permanent magnet material handling device 30, such as one of the poles 40, has the foreign material attached thereto. The movement of the plate 206 may be indicative of the undesirable presence of the foreign material. In certain examples, if the movement of the plate 206 is sufficient, the controller 214 may activate the alarm 216. The operation may thereby be alerted to the presence of the foreign material and take appropriate action to remove the foreign material from the permanent magnet material handling device 30.

The sheath 100 may be stored on the pedestal 202 when the sheath 100 is not in use. The pedestal 202 may be disposed within a working envelope of a bore liner assembly robot having the robotic end-of-arm tool 10 with the permanent magnet material handling device 30 attached thereto, for example. The sheath 100 may be attached to and removed from the permanent magnet material handling device 30 by use of robotic subroutines. In another embodiment, the sheath 100 may be attached to and removed from the permanent magnet material handling device 30 by manual means. Alternatively, the pedestal 202 for the sheath 100 may be a distinct station, not typically used for storage purposes, employed to check for the presence of foreign material attached to the permanent magnet material handling device 30 by the method described hereinabove.

It is surprisingly found that the sheath 100, assembly 200, and method of the present disclosure advantageously facilitate the assembly of bore liners into precision sand foundry molds. The sheath 100 and assembly 200 reduces pinch point hazards by minimizing the magnetic attraction of the permanent magnet material handling device 30 when not in use. It is further found that the sheath 100 and assembly 200 may be reliably employed to detect foreign material attached to the permanent magnet material handling device 30, and in particular the ferrous poles 40. Possible injury to the operator or nearby employees, and scrap molds and castings caused by foreign material attached to the permanent magnet material handling device 30, are thereby militated against. A misalignment of the bore liners into the precision sand foundry molds due to the presence of foreign material on the ferrous poles 40 is also militated against.

While certain representative embodiments and details have been shown for purposes of illustrating the invention, it will be apparent to those skilled in the art that various changes may be made without departing from the scope of the disclosure, which is further described in the following appended claims.

What is claimed is:

1. A sheath for a permanent magnet material handling device having a permanent magnet and at least one pole, comprising:

a hollow main body having an open first end and a second end, the hollow main body formed from a substantially nonmagnetic material and adapted to receive the pole of the permanent magnet material handling device and militate against an attraction of foreign material to the permanent magnet material handling device;

wherein the sheath includes one of a first coupling member integrally formed with the hollow main body and at least one inclusion disposed within a wall of the hollow main body.

2. The sheath according to claim 1, wherein the second end has a thickness that militates against a magnetic attraction of foreign material when the hollow main body receives the permanent magnet.

3. The sheath according to claim 1, wherein the sheath includes the at least one inclusion disposed within a wall of the hollow main body, and further comprising at least one first coupling member coupled to the hollow main body.

4. The sheath according to claim 3, wherein the first coupling member is integrally formed with the hollow main body.

5. The sheath according to claim 3, wherein the first coupling member is a bushing.

6. The sheath according to claim 1, wherein the sheath includes the first coupling member integrally formed with the hollow main body and further comprising at least one inclusion disposed at the second end of the hollow main body and adapted to be attracted by the pole.

7. The sheath according to claim 6, wherein the at least one inclusion is disposed within a cavity formed in the second end of the hollow main body.

8. The sheath according to claim 7, wherein the at least one inclusion is removeably secured within the cavity by a cover plate.

9. The sheath according to claim 6, wherein the at least one inclusion is a ferrous inclusion.

10. An assembly for storing a permanent magnet material handling device having a permanent magnet and at least one pole, comprising:

a sheath including a hollow main body having an open first end and a second end, the hollow main body formed from a substantially nonmagnetic material and adapted to receive the pole of the permanent magnet material handling device and militate against an attraction of foreign material to the permanent magnet material handling device; and a pedestal including a stationary base coupled to a plate, the plate selectively engaging the sheath;

wherein the sheath includes one of a first coupling member integrally formed with the hollow main body and at least one inclusion disposed within a wall of the hollow main body.

11. The assembly according to claim 10, further comprising at least one movement facilitating member disposed between the plate and the base that enables a limited movement of the plate relative to the base.

12. The assembly according to claim 10, wherein the pedestal includes a movement sensor coupled to the plate and adapted to detect a movement of the plate relative to the base.

13. The assembly according to claim 12, further comprising an alarm in electrical communication with the movement sensor and configured to alert an operator upon detection of a predetermined movement by the movement sensor.

14. The assembly according to claim 10, wherein the sheath includes the at least one inclusion disposed within a wall of the hollow main body, the plate has at least one second coupling member coupled thereto, and the sheath has at least one first coupling member coupled thereto, the first coupling member cooperating with the second coupling member to militate against movement of the sheath when the sheath engages the pedestal.

15. The assembly according to claim 14, wherein the first coupling member is a bushing and the second coupling member is a pin.

16. A method for storing a permanent magnet material handling device, comprising the steps of:

providing the permanent magnet material handling device having a permanent magnet and at least one pole;

providing a sheath including a hollow main body having an open first end and a second end, the hollow main body formed from a substantially nonmagnetic material;

inserting the permanent magnet material handling device into the sheath; and removing the permanent magnet material handling device from the sheath when employment of the permanent magnet material handling device is desired;

wherein the sheath includes one of a first coupling member integrally formed with the hollow main body and at least one inclusion disposed within a wall of the hollow main body.

17. The method according to claim 16, further comprising the steps of:

providing a pedestal having a stationary base coupled to a plate, the plate selectively engaging the sheath;

disposing the sheath on the pedestal to place the sheath in engagement with the plate; and monitoring for foreign material on the permanent magnet material handling device during the insertion of the permanent magnet into the sheath.

18. The method according to claim 17, wherein the sheath includes the first coupling member integrally formed with the hollow main body, the first coupling member is a bushing, and the plate has at least one pin, wherein the step of disposing the sheath on the pedestal includes the step of: lowering the bushing onto the pin to engage the sheath with the plate.

19. The method according to claim 17, wherein the step of monitoring for foreign material includes the step of detecting a movement of the plate during the insertion of the permanent magnet into the sheath.

20. The method according to claim 17, further comprising the step of activating an alarm to alert an operator when the foreign material is detected on the permanent magnet material handling device.

* * * * *